United States Patent [19]

List

[11] 4,131,069

[45] Dec. 26, 1978

[54] ARTICULATED RAILWAY CAR TRUCKS

[75] Inventor: Harold A. List, Bethlehem, Pa.

[73] Assignee: Railway Engineering Associates, Inc., Bethlehem, Pa.

[21] Appl. No.: 608,596

[22] Filed: Aug. 28, 1975

Related U.S. Application Data

[63] Continuation-in-part of Ser. No. 438,334, Jan. 31, 1974, abandoned, which is a continuation-in-part of Ser. No. 222,999, Feb. 2, 1972, Pat. No. 3,789,770, which is a continuation of Ser. No. 882,359, Dec. 15, 1969, abandoned, which is a continuation of Ser. No. 680,257, Nov. 2, 1967, abandoned.

[51] Int. Cl.[2] ..... B61F 3/08; B61F 5/14; B61F 5/24; B61F 5/52

[52] U.S. Cl. ..... 105/168; 105/176; 105/182 R; 105/199 R; 105/224.1

[58] Field of Search ..... 105/165, 166, 167, 168, 105/169, 170, 176, 179, 182 R, 224.1

[56] References Cited

U.S. PATENT DOCUMENTS

| | | | |
|---|---|---|---|
| 33,167 | 8/1861 | Youmans | 105/176 |
| 243,797 | 7/1881 | Robinson | 105/168 |
| 502,503 | 8/1893 | Shaw | 105/176 |
| 1,640,179 | 8/1927 | Buckwalter | 105/182 R |
| 1,707,046 | 3/1929 | Boyden | 105/165 |
| 1,744,986 | 1/1930 | Richards | 105/168 X |
| 1,772,928 | 8/1930 | Kijlstra | 105/168 X |
| 2,042,623 | 1/1936 | Montrose-Oster | 105/169 |
| 2,296,106 | 9/1942 | Holland et al. | 105/167 |
| 2,360,061 | 10/1944 | Jones | 105/167 |
| 3,274,955 | 9/1966 | Thomas | 105/224.1 |
| 3,789,770 | 2/1974 | List | 105/168 |
| 3,948,188 | 4/1976 | Zehnder | 105/224 R X |
| 4,003,316 | 1/1977 | Monselle | 105/167 |
| 4,067,261 | 1/1978 | Scheffel | 105/182 R X |
| 4,067,262 | 1/1978 | Scheffel | 105/168 |

FOREIGN PATENT DOCUMENTS

| | | | |
|---|---|---|---|
| 642321 | 6/1962 | Canada | 105/168 |
| 698023 | 11/1964 | Canada | 105/168 |
| 799724 | 11/1968 | Canada | 105/168 |
| 1018404 | 10/1977 | Canada | 105/168 |

OTHER PUBLICATIONS

List, HA, An Evaluation of Recent Developments I Rail Car Truck Design, Apr. 21, 1971, American Society Mechanical Engineers Publication.

*Primary Examiner*—Albert J. Makay
*Assistant Examiner*—Howard Beltran
*Attorney, Agent, or Firm*—Raymond H. Synnestvedt; Kenneth P. Synnestvedt

[57] ABSTRACT

A vehicle running gear with articulated, self-aligning, wheelsets having means providing elastic restraint of steering moments. This means ensures that the axles of the wheelsets, while free to yaw conjointly to assume a radial position in curves, are restrained from unstable steering motions when operating in a relatively straight line at high speeds.

The wheelset bearings are each carried by a subtruck which is shaped to provide a steering arm, and these arms are movably coupled in a region intermediate the axles, to accommodate conjoint yawing motions of the axles with respect to each other and in the general plane of the axles. Particular attention is given to the importance of "yaw" and "lateral" restraints, between the two wheelsets of a truck and, in each of the disclosed embodiments, resilient means of predetermined stiffness is constructed and disposed to oppose departure of the arms from a position in which the wheelsets are parallel, while other resilient means reacts between the steering arms, in the region of their coupling, and opposes differential yawing, or lateral motion of the axles, across the line of general vehicle motion. Elastomeric pads or blocks are disclosed as providing the damping and, in some disclosed arrangements, the degree of restraint of the movements of one axle differs from the degree of restraint of another axle. In accordance with one disclosed feature, coupling is also provided between one steering arm and the vehicle body, to control yawing between the wheelsets and the body.

According to another portion of the disclosure, brake improvements, for a railway vehicle, reduce brake shoe wear, and eliminate contact between the brake shoes and the wheel flanges.

22 Claims, 19 Drawing Figures

Fig. 9.
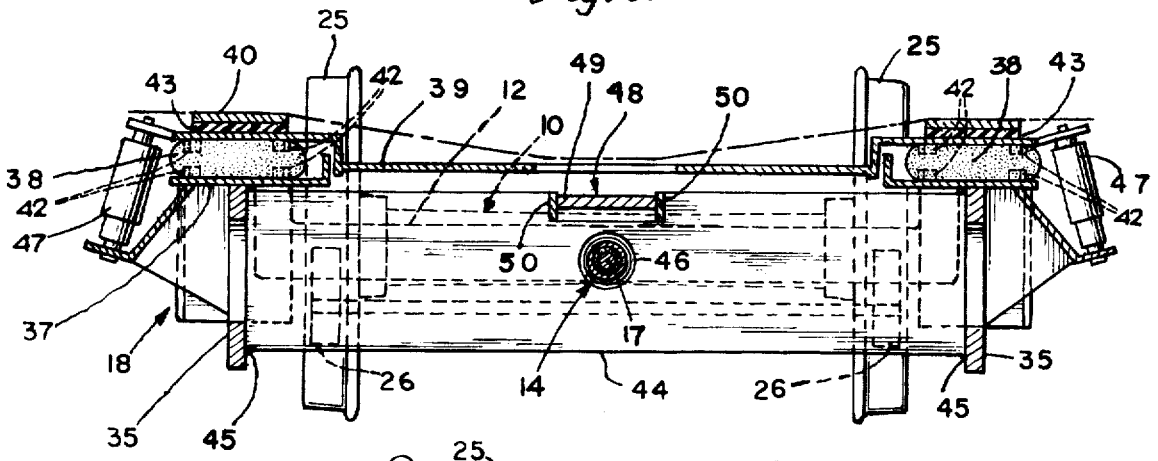
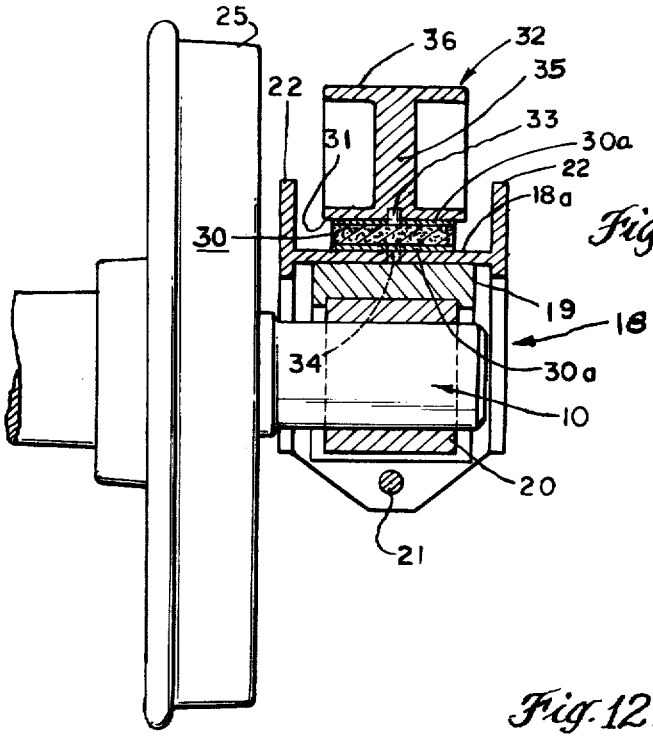
Fig. 10.
Fig. 11.
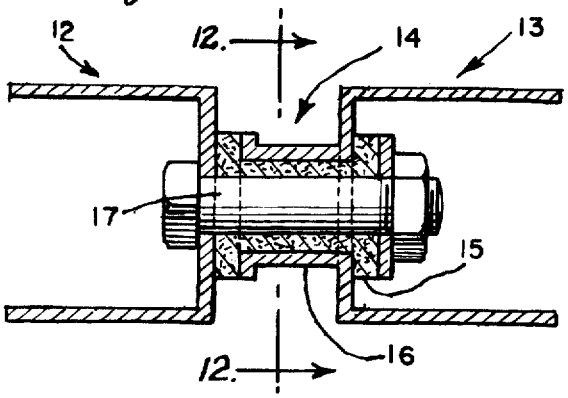
Fig. 12.
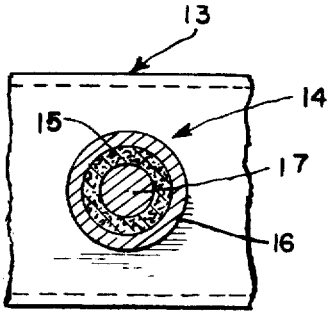

Fig. 13.
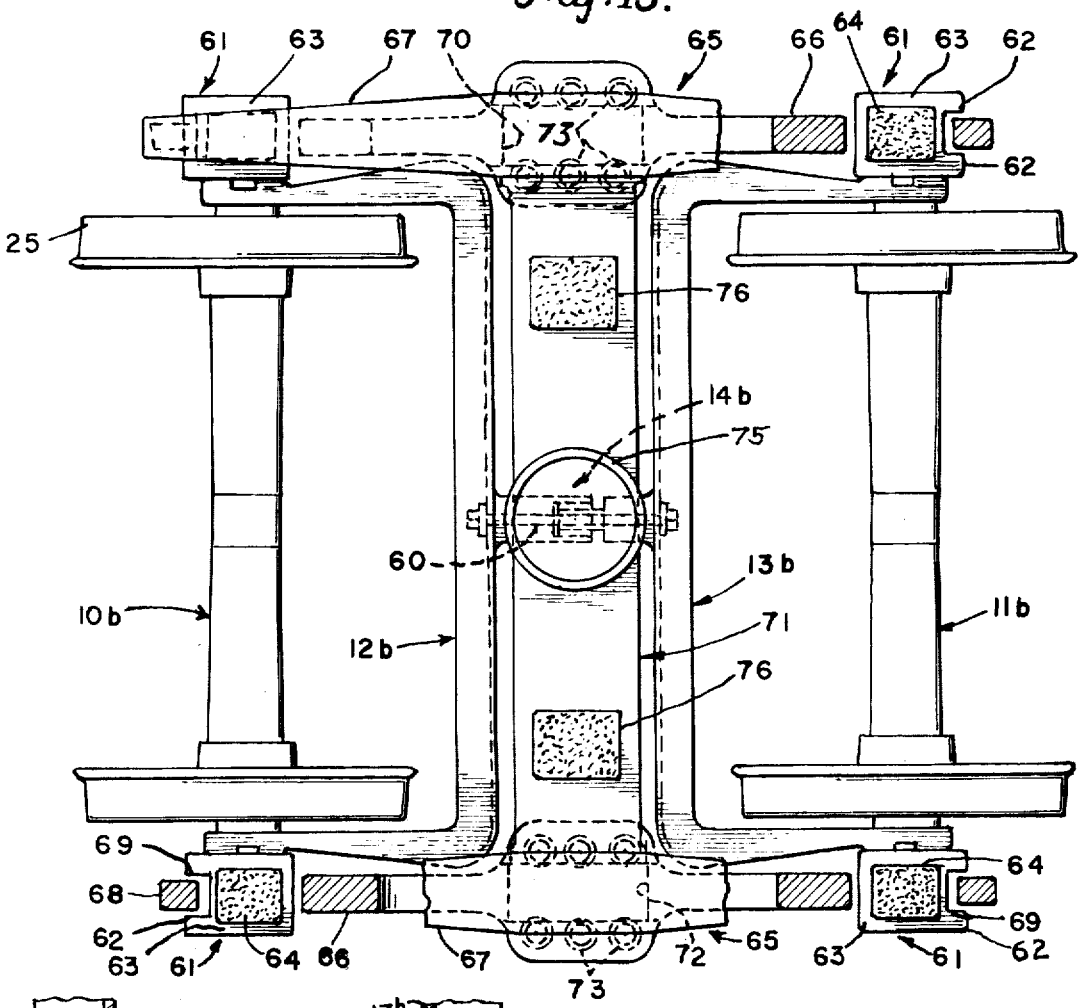
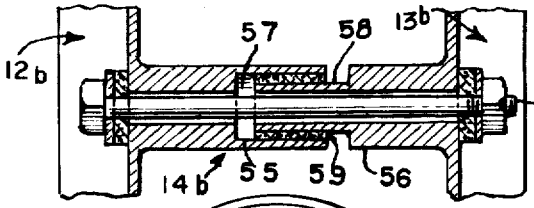
Fig. 15.
Fig. 14.
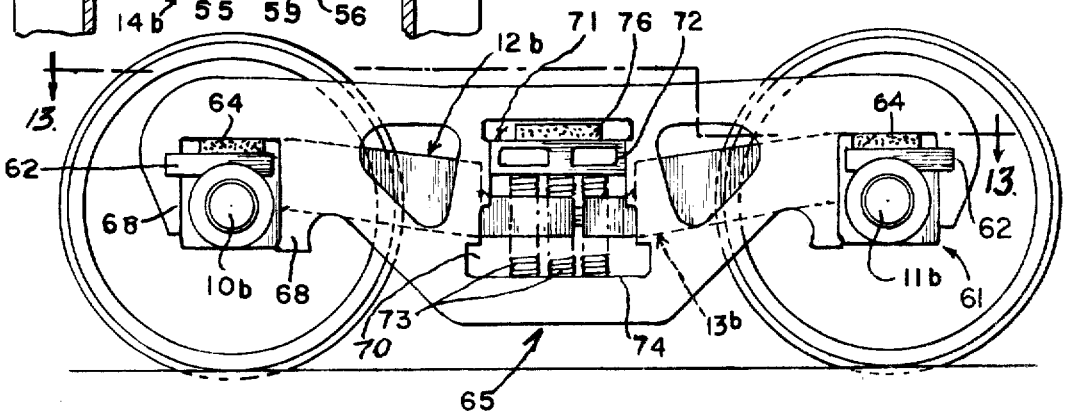

ARTICULATED RAILWAY CAR TRUCKS

This application is a continuation-in-part of my copending application Ser. No. 438,334, filed Jan. 31, 1974, now abandoned, which is a continuation-in-part of application Ser. No. 222,999, filed Feb. 2, 1972 (which issued as U.S. Pat. No. 3,789,770, dated Feb. 5, 1974), which application was a continuation of application Ser. No. 882,359 filed Dec. 15, 1969, and which was, in turn, a continuation of my original application Ser. No. 680,257 filed Nov. 2, 1967. The said application Ser. Nos. 680,257 and 882,359 were successively abandoned, but the subject-matter thereof was continuously pending to the date of issuance of said U.S. Pat. No. 3,789,770.

BACKGROUND OF THE INVENTION

While of broader applicability, for example in the field of highway vehicles where use of certain features of the invention can reduce lateral scrubbing of tires as well as lessening the width of the roadway required for negotiating curves, my invention is especially useful in railway vehicles and particularly railway trucks having a plurality of axles. Accordingly, and for exemplary purposes, the invention will be illustrated and described with specific reference to railway rolling stock.

The axles of the railway trucks now in normal use remain substantially parallel at all times (viewed in plan). A most important consequence of this is that the leading axle can not assume a position radial to a curved track, and the flanges of the wheels strike the curved rails at an angle, causing objectionable noise and excessive wear of both flanges and rails.

Much consideration has been given to the avoidance of this problem, notably the longstanding use of wheels the treads of which have a conical profile. This expedient has assisted the vehicle truck to negotiate very gradual curves. However, as economic factors have led the railroads to accept higher wheel loads and operating speeds, the rate of wheel and rail wear becomes a major problem. A second serious limitation on performance and maintenance is the result of excessive, and even violent, oscillation of the trucks at high speed on straight track. In such "nosing", or "hunting", of the truck the wheelsets bounce back and forth between the rails. Above a critical speed hunting will be initiated by any track irregularity. Once started, the hunting action will often persist for miles with flange impact, excessive roughness, wear and noise, even if the speed be reduced substantially below the critical value.

In recent efforts to overcome this curving problem, yaw flexibility has been introduced into the design of some trucks, and arrangements have even been proposed which allow wheel axles of a truck to swing and thus to become positioned substantially radially of a curved track. However, such efforts have not met with any real success, primarily because of lack of recognition of the importance of providing the required lateral restraint, as well as yaw flexibility, between the two wheelsets of a truck, to prevent high speed hunting.

For the purposes of this invention, yaw stiffness can be defined as the restraint of angular motion of wheelsets in the steering direction, and more particularly to the restraint of conjoint yawing of a coupled pair of wheelsets in a truck. The "lateral" stiffness is defined as the restraint of the motion of a wheelset in the direction of its general axis of rotation, that is, across the line of general motion of the vehicle. In the apparatus of the invention, such lateral stiffness also acts as restraint on differential yawing, of a coupled pair of wheelsets.

The above-mentioned general problems produce many particular difficulties all of which contribute to excessive cost of operation. For example, there is deterioration of the rail, as well as widening of the gauge in curved track. In straight track the hunting, or nosing, of the trucks causes high dynamic loading of the track fasteners, and of the press fit of the wheels on the axles, with resultant loosening and risk of failure. A corresponding increased cost of maintenance of both trucks and cars also occurs. As to trucks, mention may be made, by way of example, to flange wear and high wear rates of the bolster and of the surfaces of the side framing and its bearing adapters.

As to cars, there occurs excessive center plate wear, as well as structural fatigue and heightened risk of derailment resulting from excessive flange forces. The effects on power requirements and operating costs, which result from wear problems of the kinds mentioned above, will be evident to one skilled in this art.

In brief, the lack of recognition of the part played by yaw and lateral stiffness has led to: (a) flange contact in nearly all curves; (b) high flange forces when flange contact occurs; and (c) excessive difficulty with lateral oscillation at high speed. The wear and cost problems which result from failure to provide proper values of yaw and lateral stiffness, and to control such values, will now be understood.

SUMMARY OF THE INVENTION

It is the general objective of my invention to overcome such problems, and to this end I utilize an articulated truck having novelly positioned elastic restraint means which makes it possible to achieve flange-free operation in gradual curves, low flange forces in sharp curves, and good high speed stability.

I have further discovered that application of certain principles of this invention to highway vehicles not only reduces tire scrubbing and highway space requirements, as noted above, but also promotes good stability at high speed.

To achieve these general purposes, and with particular reference to railway trucks, the invention provides an articulated truck so constructed that: (a) each axle has its own, frequently individual, value of yaw stiffness with respect to the truck framing; (b) such lateral stiffness is provided as to ensure the exchanging of steering moments properly between the axles and also with the vehicle body; and (c) the proper value of yaw stiffness is provided between the truck and the vehicle.

An embodiment representative of the invention has been tested at nearly eighty miles per hour, with virtually no trace of instability. With another embodiment, radial curving has been observed at less than 50 foot radius, and flange-free operation is readily achieved with all embodiments on curves of at least 4°.

With more particularity, it is an objective flexibly to restrain yawing motion of the axles by the provision of restraining means of predetermined value between the side frames and the steering arms of a truck having a pair of subtrucks coupled through steering arms rigidly supporting the axles. Elastomeric means for this purpose is provided between the axles and the side frames, preferably in the region of the bearing means. Such means may be provided at one or both axles of the truck. If provided at both axles, it may have either more or less restraint at one axle, as compared with the restraint at the other, depending upon the requirements of the particular truck design.

It is a further object of this invention to provide elastomeric restraining means in the region of the coupling between the arms to damp lateral axle motions, which results in so-called "differential" yawing of a coupled pair of subtrucks.

The invention is also featured by certain tow bar improvements which take care of longitudinal forces between the car body and the flexibly mounted wheelsets. This arrangement has several advantages, discussed hereinafter, one of which is to prevent excessive deflections, in the elastomeric pads which mount the steering arms to the side frames and the side frames to the car body.

In accordance with another feature of the invention, a special sliding bearing surface is provided between the truck side frames and the car body, further to limit the flange forces in very sharp curves.

My invention also contemplates brake improvements which, when used in conjunction with articulated trucks characteristic of this invention, virtually eliminate contact of the brake shoes with the wheel flanges. Prior to the invention such contact has resulted in substantial wear and in uneven braking.

BRIEF DESCRIPTION OF THE DRAWINGS

Several embodiments representative of my invention are illustrated.

In the drawings:

FIG. 9 is a cross-sectional view taken on the line 9—9 of FIG. 6;

FIG. 10 is an enlarged cross-sectional view of the journal box structure taken on the line 10—10 of FIG. 6;

FIG. 11 is an enlarged sectional view of the central connection of the steering arms taken on the line 11—11 of FIG. 7;

FIG. 12 is a cross section taken on the line 12—12 of FIG. 11;

FIG. 13 is a plan view illustrating a modified form of railway truck embodying the invention which uses side frame and bolster castings similar to those used in conventional freight car trucks;

FIG. 14 is a side elevational view of the apparatus of FIG. 13;

FIG. 15 is an enlarged sectional plan view of the central connection device of the steering arms of the truck of FIGS. 13 and 14;

DESCRIPTION OF REPRESENTATIVE EMBODIMENTS

Figure 1:
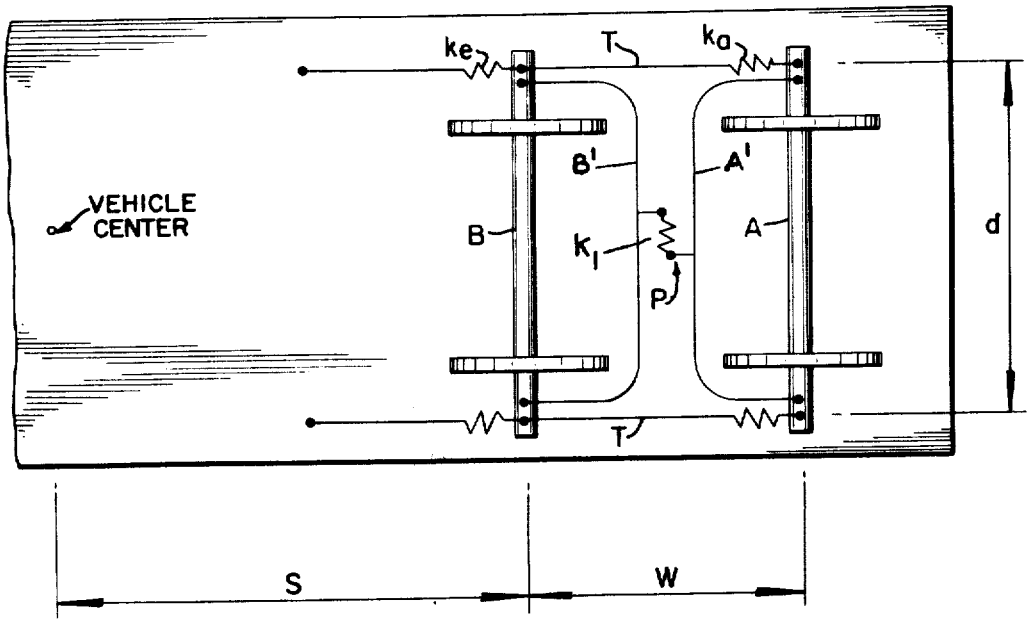
FIG. 1 is a schematic showing of a first embodiment of the invention, and illustrating a railway vehicle having truck means which includes a pair of wheelsets coupled and damped in accordance with principles of the invention.
Figure 2:
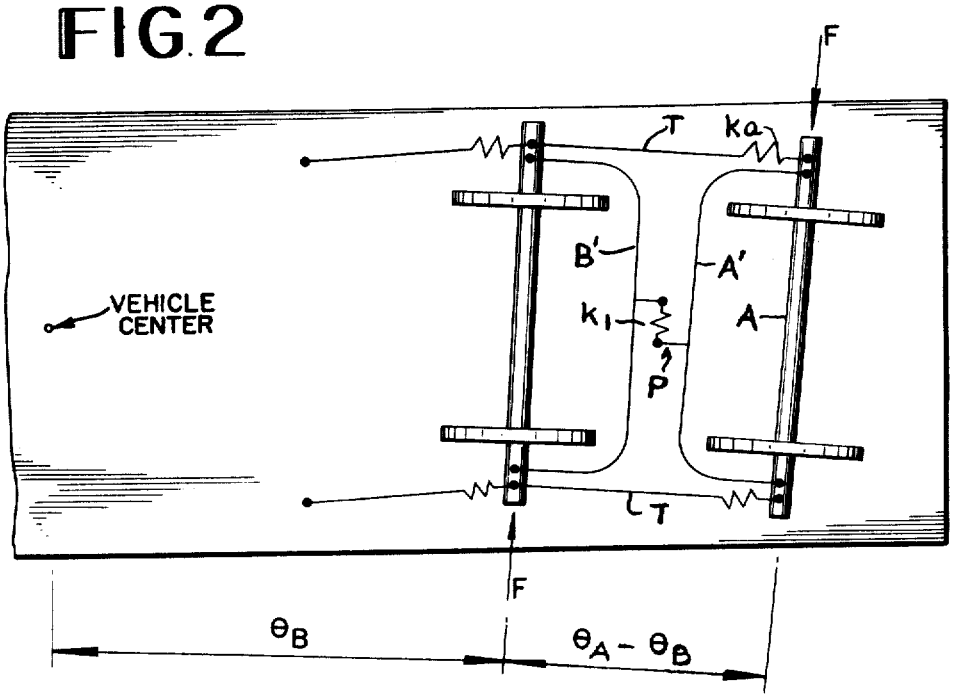
FIG. 2 shows schematically, and in basic terms, the response of such a truck to a curve.

The steering features of a first embodiment for a four wheel railroad car truck are illustrated somewhat schematically in FIGS. 1 and 2. The embodiment for use under the trailing end of a highway vehicle would be virtually identical, but, for simplicity, railroad truck terminology is used in the description.

The essential parameters are as follows:

The yaw (longitudinal) stiffness between the "inside" axle "B" and the truck side frames "T" is very high, i.e. a pinned connection.

The yaw stiffness between the "end" axle "A" and the truck side frames "T" is $k_a$.

The yaw stiffness between the truck side frames "T" and the vehicle is $k_e$.

The side frames "T" are essentially independent being free to align themselves over the bearings (not illustrated) of axles "A" and "B", even when there is substantial deflection in the longitudinal direction of the resilient member $k_a$.

Lateral forces between the two axles are exchanged at point "P", located in the mid-region between a pair of subtrucks, or steering arms, A' and B'. This interconnection has a lateral stiffness of $k_l$ and may also make a contribution to the yaw stiffness between the two axles. This connection provides for balancing of steering moments between the two axles, as well as providing the lateral stiffness.

The basic response of such a truck to a curve is shown in FIG. 2. The elastic restraints $k_a$ and $k_e$ have been deflected by lateral forces "F". The forces "F" can arise either from flange contact or from steering moments caused by creep forces between the wheels and the rails. Experimentally it has been observed that for relatively low values of $k_a$ and $k_e$, the axles will tend to assume a radial position in curves for a large range of variation of the ratio $k_a/k_e$. I have further discovered that for higher values, the proper value for this ratio must be chosen as a function of the truck wheelbase "w" and the distance s from axle "B" to the vehicle center. Thus a means is provided to have the high value for yaw stiffness needed for high speed stability while simultaneously providing radial positioning of the axles in sharp curves. The basic mathematical relationships which assure radial positioning of the axles are as follows:

For the axles to be in a radial position, their angular displacement will be proportioned to their distance from the center of the car body;

$$\theta_A - \theta_B = c \times w \text{ and } \theta_B = c \times s.$$

where $c$ = the curvature per foot of length along the curve.

This gives the following ratio between the angles and the distances.

$$\theta_A - \theta_B/\theta_B = w/s$$

The angles are also independent on the yaw stiffness.

$$\theta_A - \theta_B = (F \times w/2)/(k_a \times d) \text{ and } \theta_B = F \times w/k_e \times {}^{-}d$$

Substituting, we find that the relationship between the yaw stiffnesses and the distance should be;

$$k_e = k_a \times 2w/s, \text{ or } k_a/k_e = s/2w.$$

Given the proportionality $k_a/k_e = s/2w$ it is a simple matter to translate the values for elastic restraint into suitable components. In the design and testing of one of the truck embodiments described below, the value for $k_a$ was selected to obtain stability against hunting up to a car speed of one hundred miles per hour. With this component established, use of the proportionality considered above readily yields the values to be embodied in the other elastomeric restraints, which are disposed between the car body and side frame ($k_e$).

In the case of rail vehicles where there is only a small clearance between the wheel flanges and the rail, the above ratio should be closely maintained. The action of the forces arising from the self steering moments of the wheelsets will correct for some error, and the curving behavior will be superior to a conventional truck, even if it is not perfect.

In the case of highway vehicles, when a low value of $k_a$ is chosen, the rear bogie will tend to follow the front end of the vehicle rather precisely in a curve. As $k_a$ is increased, the trailing end of the vehicle will track inside the front end. If $k_a$ is made very stiff, the bogie will approach, but always be superior to, the tracking characteristics of a conventional bogie. As will be understood, given $k_a$, $k_e$ can be calculated.

Figure 3:
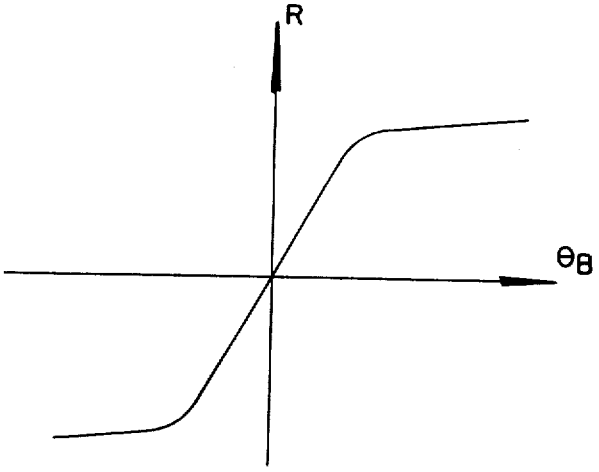
FIG. 3 shows a plot of the reaction of the flange force between the truck side frames and the vehicle, using modified restraining means and under conditions of very sharp curving, the reaction being plotted against the angle of track curvature.

While the embodiment shown in FIGS. 1 and 2 will provide the desired major improvement in curving behavior and high speed stability on all ordinary railroad curves, there is also a need to limit the flange force "F" which occurs when operating occasionally on very sharp curves. This is most easily done by making $k_e$ a non-linear elastic restraint as shown in FIG. 3.

This restraint is comprised of a steep linear center section where $k_e = k_a \times 2w/s$ and end sections where the value is much less. This will limit the reaction force "R" between the truck sideframes and the vehicle, which will in turn limit the flange force "F".

Figure 4:
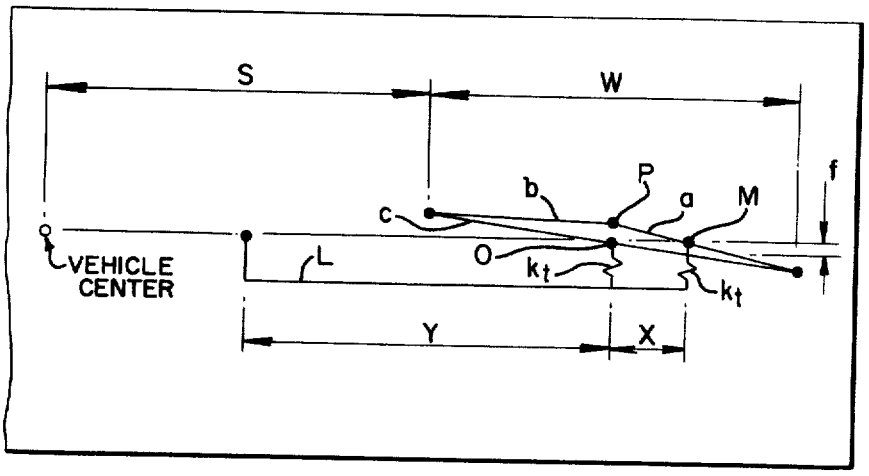
FIG. 4 is a force diagram analyzing the response of a truck generally similar to that shown in FIG. 1, and including in addition a steering link or tow bar.

For certain applications such as rail rapid transit vehicles where there is a need to obtain the lowest possible flangwear and operating noise on sharp curves, and at the same time obtain good high speed stability, it will be found desirable to add the feature shown in FIG. 4. The addition of steering link, or tow bar, "L" provides a means to keep the yaw stiffness high on straight track without contributing significantly to the flange force in curves. The presence of the restraints $k_t$ make it possible to choose low values for $k_a$ and $k_e$ without sacrificing yaw stiffness between the vehicle and the running-gear and within the running-gear.

The following parameters are dealt with in consideration of FIG. 4:

s = distance from vehicle center to closest axle;

w = truck wheelbase, axle-to-axle;

b = center line of subtruck (steering arm) associated with axle B;

a = center line of subtruck (steering arm) associated with axle A;

c = center line of truck framing;

O = center (pivot point) of truck framing;

P = point of interconnection of the subtrucks;

L = tow bar (steering link). In FIG. 4 it is shown offset from the vehicle centerline better to show $k_t$;

M = the point of interconnection between the tow bar and subtruck a;

x = the distance between the truck center O and the interconnection at M;

$k_t$ = the lateral flexibility which limits the ability of the steering link to keep the lateral position of M the same as the lateral position of P; [When certain prototype trucks were operated in the FIG. 4 configuration, $k_t$ was the lateral stiffness of pads used to provide $k_a$ between the side frames and the subtrucks.]

y = the distance between the connection of the steering link to the truck framing at M, and the point of connection of the link to the vehicle; and f = the distance between the truck centerline and point M at the distance x from the truck center. This dimension is used in deriving the computation of the proper dimension for x.

The optimum values for x and $k_t$ must be found by experiment. However, it can be shown that x should be larger than a specific minimum at which the axles would assume a radial position if the restraints $k_t$ were infinitely rigid. This minimum value can be calculated using the equation $x_{min} = w^2/4\ (s + w)$. This value is based on the fact that the angle between "b" (L to axle B, FIGS. 1 and 2) and the vehicle center line, and the angle between "a" (L to axle A, FIGS. 1 and 2) and the vehicle centerline are proportional to the distances from the center of the vehicle ($w$ and $s + w$). The lateral distance "f" in FIG. 4 can be calculated two ways, i.e.:

$$(1)\ f = 1/r\ (2s + w)\ x \text{ and;}$$

$$(2)\ f = 1/r\ (w/2 - x)\ w \text{ where } 1/r \text{ is the track curvature.}$$

Equating these two expressions;

$$2sx + wx = (w/2 - x)\ w$$

Solving for x gives;

$$x = w^2/4\ (s + w).$$

The optimum value for $k_t$ will depend primarily on the total value for yaw stiffness required for high speed stability, the percentage of that value supplied by $k_a$ and $k_e$, and the percentage of that value contributed by the rotational stiffness of the connection at P. The value $k_t$ can be chosen to make up the remainder required.

There is also the question of choosing a proper value for y. This should in general be chosen as long as practical, if it is desired to minimize coupling between the lateral motion of the vehicle with respect to the running-gear and the steering motions of the axles. However the length y has been made as short as two thirds w with success in prototypes, there being some indication in testing that a certain amount of coupling between lateral motion of the car body, with respect to the truck, and the steering action of the truck helps to stabilize lateral motions of the car body.

The principles disclosed above can be used directly to design running-gear having an even number of axles by grouping them in pairs. These principles have also been used to design a three-axle bogie.

Figure 17:
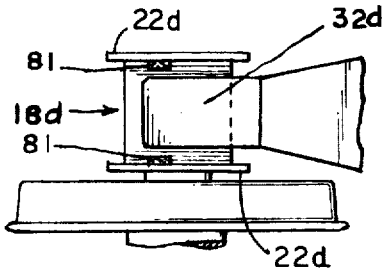
FIG. 17 is a fragmentary plan view of a modification illustrating lateral stops for the side frames of a truck of the general kind shown in FIGS. 5–10.
Figure 18:
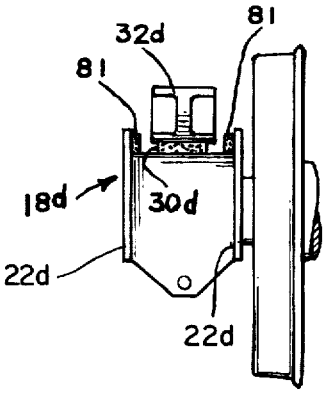
FIG. 18 is a fragmentary end view of the apparatus of FIG. 17.

The principles considered above have been applied in the design of a number of specific trucks, particularly railway freight trucks. By way of example, three such embodiments are shown. One appears in FIGS. 5 to 12, another in FIGS. 13 to 15, and the third in FIG. 16. Detail modifications are shown in FIGS. 17 and 18.

With detailed reference, initially, to FIGS. 7 and 8, from which parts have been omitted more clearly to show the manner in which each of two axles 10 and 11 is rigidly supported by its subframe (termed a "steering arm" in the following description), it will be seen that each axle is carried by its steering arm, 12 and 13, respectively, and that each axle has a substantially fixed angularity with respect to its steering arm, in the general plane of the pair of axles. The steering arms are generally C-shaped, as viewed in plan, (c.f. the steering arms A' and B' of FIGS. 1 and 2), and each has a portion extending from its associated axle to a common region (12*a*, 13*a*) substantially midway between the two axles. Means bearing the general designation 14, to which more detailed reference is made below, couples the steering arms 12 and 13 with freedom for relative pivotal movement and with predetermined stiffness against lateral motion in the general direction of axle extension. In this embodiment the stiffness against lateral motion, in the direction of axle extension and in the plane of the axles (it corresponds to the resilient means $K_1$ shown diagrammatically at P in FIG. 1), takes the form of a tubular block 15 of any suitable elastomeric material, e.g. rubber. It is suitably bonded to a ferrule, or bushing 16 (see particularly FIGS. 11 and 12), which is provided as an extension of steering arm 13, and to a bolt 17 which couples the steering arms, as is evident. This block or pad 15, through which the steering moments are exchanged, has considerable lateral stiffness. The resilience is sufficient so that each axle is free to assume a position radial of a curved track, and sufficient to allow a slight parallel yaw motion of the axles. This acts to prevent flange contact on straight track when there are lateral loads such as strong cross winds.

Figure 7:
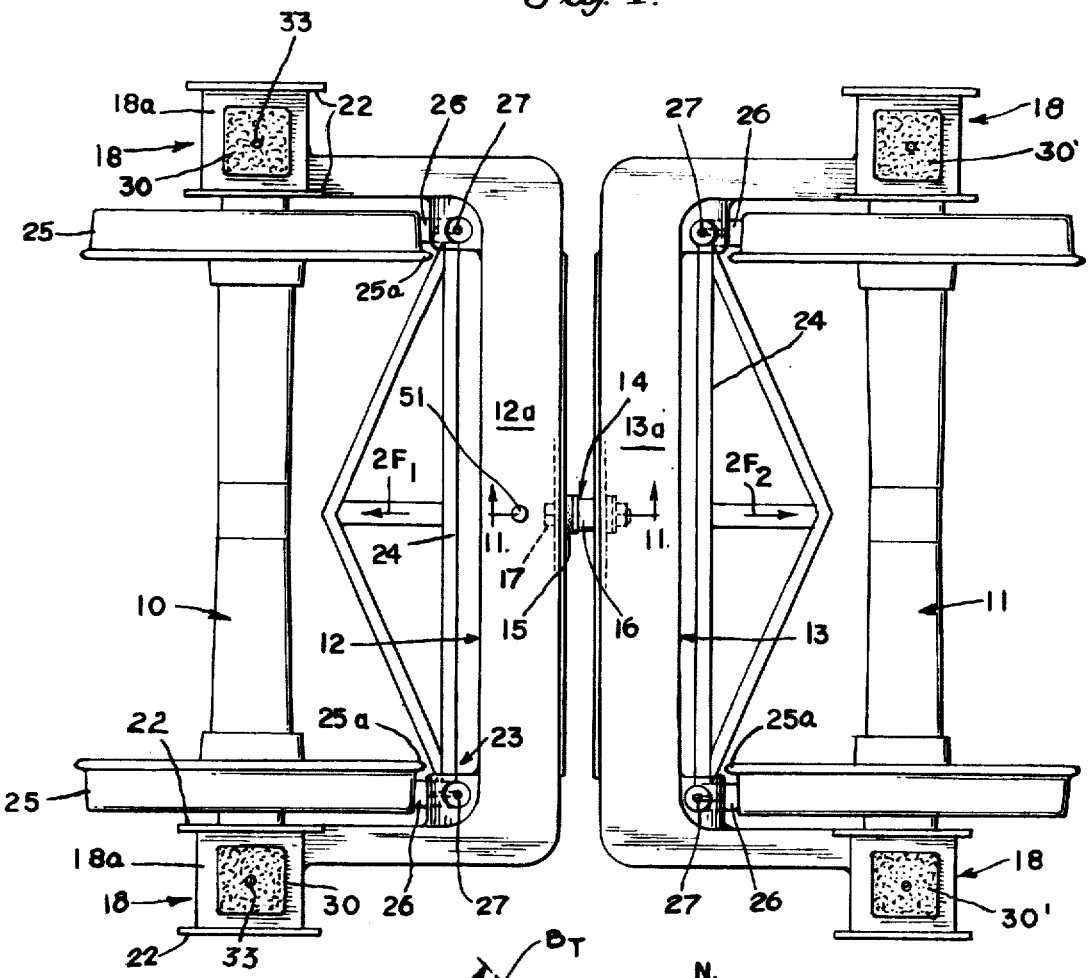
FIG. 7 is a plan view of the railway truck of FIGS. 5 and 6 with certain upper parts omitted, in order more clearly to show the steering arms, their central connection, and features of brake rigging.
Figure 8A:
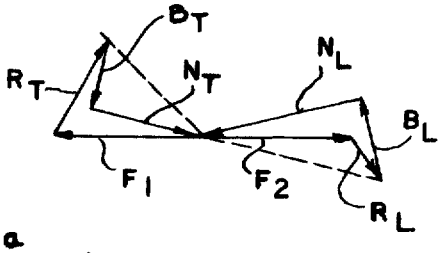
FIG. 8a is a force polygon illustrating the functioning of the brakes.
Figure 8:
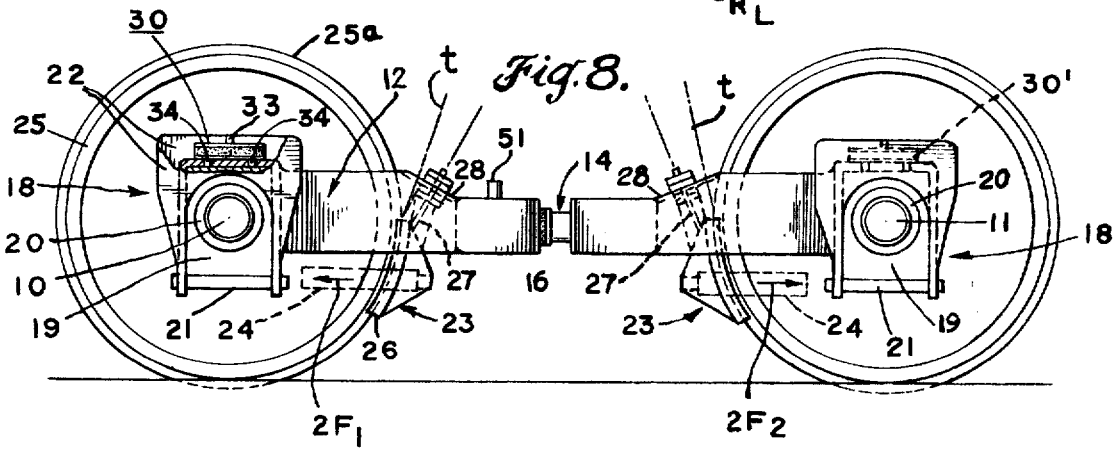
FIG. 8 is a side elevational view of the apparatus shown in FIG. 7.

Turning now to the manner in which each axle is carried by its associated arm, it is seen that each steering arm carries, at each of its free ends, journal box structure 18 integral with the arm (see for example arm 12 in FIGS. 7 and 8). The box shape can readily be seen from the figures and opens downwardly to receive bearing adapter structure 19, of known type, which locates the bearing cartridge 20. Both ends of both axles 10 and 11 are mounted in this fashion, which does not require more detailed description herein. Retaining bolts 21 prevent the bearing 20 from falling out of the adapter 19 when the car truck is lifted by the truck framing.

Each journal box 18 has spaced flanges 22,22 which have portions extending upwardly and laterally of the journal box. These flanges serve as retaining means for the car side frames, and also for novel pads interposed between the journal boxes and the side frames, as will presently be described. However, before proceeding with that description, and still with reference to FIGS. 7 and 8, it will be noted that each steering arm 12 and 13 carries a novel brake and brake beam assembly. These assemblies are designated, generally, at 23 (FIG. 3) and each includes a braced brake beam 24, extending transversely between the wheels (e.g. the wheels 25,25 carried by axle 10), and each end of each beam carries a brake shoe 26 which is aligned with and disposed for contact with the confronting tread of the wheel. The mounting of the brake assemblies is characteristic of this invention — in which each axle is fixed as against swinging movements with respect to its associated steering arm — and has significant advantages considered later in this description. For present purposes it is sufficient to point out that the brake beams 24 are prevented from moving laterally toward and away from the flanges 25*a* of the wheels, and for this purpose the opposite end portions of the beams are carried by rod-like hangers 27, each of which extends through and is secured in a sloped pad 28 provided in corner portions of each steering arm 12 and 13 (see particularly FIG. 8).

Figure 5:
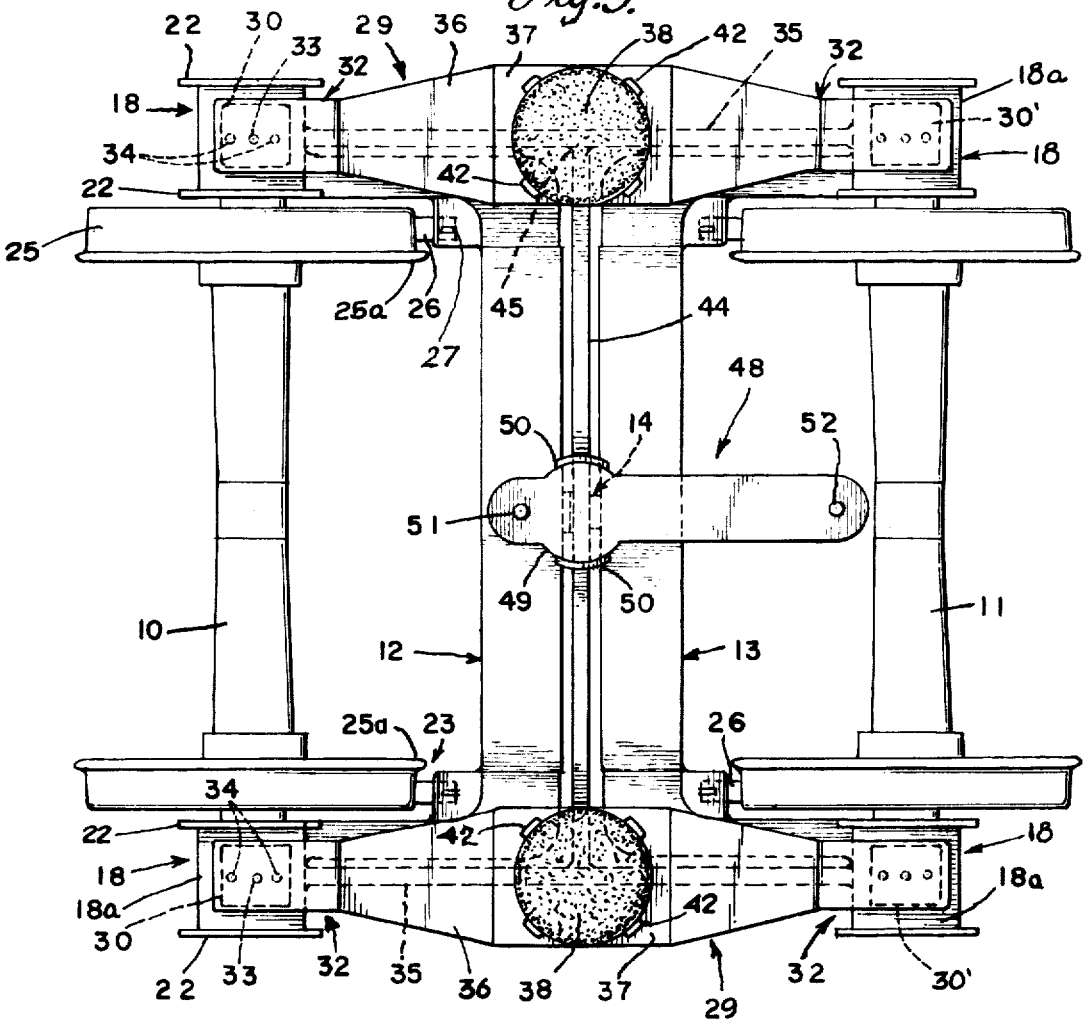
FIG. 5 is a plan view of a railway truck constructed in accordance with the invention, and embodying principles illustrated schematically in FIGS. 1 and 4.
Figure 6:
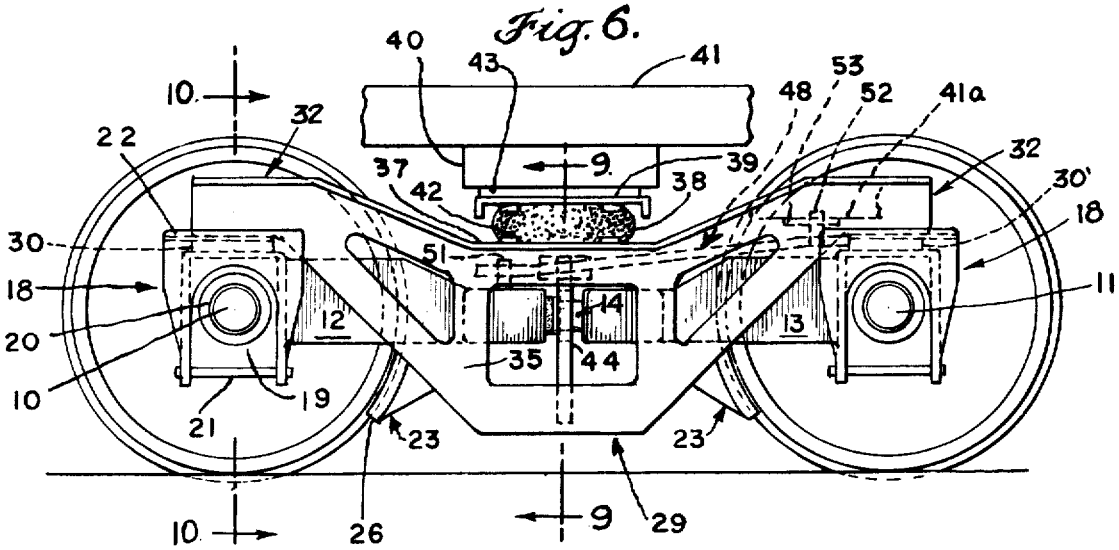
FIG. 6 is a side elevational view of the apparatus shown in FIG. 5.

In particular accordance with my invention, and with reference to FIGS. 5 and 6, reference is now made to the manner in which the truck side frames 29,29 are carried by the steering arms, being supported upon elastomeric means which flexibly restrains conjoint yawing motions of the coupled pair of wheelsets, that is provides restraint of the steering motions of the axles with respect to each other, and thus opposes departure of the subtrucks (the steering arms and their axles) from a position in which the wheelsets are parallel. As will now be understood from FIGS. 2 and 3, described above, this restraining means ($k_a$ in those figures) may be provided only at the ends of that axle which is more remote from the center of the vehicle. However, it is frequently desirable to provide such restraint at the ends of each axle. Accordingly, FIGS. 5 and 8 show restraint at each axle; it can be of different value at each, depending upon the particular truck design.

As shown in FIGS. 5 and 8, the restraining means takes the form of elastomeric pads 30, preferably of rubber, supported upon the journal box, between the flanges 22, and interposed between the upwardly presented, flat, surface 18*a* of each journal box 18 and the confronting lower surface 31 (FIG. 10) of the I-beam structure which comprises the outboard end portions 32 of each side frame 29. As indicated in FIGS. 7 and 8, and as shown to best advantage in FIG. 10, the pads 30 are sandwiched between thin steel plates 30*a*, 30*a*, the upper of which carries a dowel 33 and the lower of which is provided with a pair of dowels 34. The upper and lower dowels are received within suitable apertures provided, respectively, within the surface 31 of side frame end portion 32, and the confronting surface 18*a* of journal box 18. The purpose of the dowels is to locate the elastomeric pads 30 with respect to the journal box, and to position the side frame with respect to the pad 30. The side frame is thus supported upon the pads and between the flanges 22.

As shown in FIG. 6, each side frame 29 has a center portion which is lower (when viewed in side elevation) that its end portions 32. This center portion includes part of a web 35 having a top, laterally extending, flange 36 which is narrower at its outer extremities (FIG. 5) which overlie the journal box 18, and provides the bearing surface 31 (FIG. 10). The flange 36 reaches its maximum width in a flat central section 37 which comprises a seat for supporting an elastomeric spring member 38. This member has the form, prior to imposition of the load, of a rubber sphere. Member 38, although not so shown in the drawings, may if desired be sandwiched between steel wear plates. Desirably, and as shown, means is provided for locating the member 38 with respect to the seat 37 of the side frame, and with respect to the overlying car bolster 39 (FIGS. 6 and 9), which, with sill 40, spans the width of the car and is secured thereto. The car is illustrated fragmentarily at 41, in FIG. 6. This locating means, as shown in FIGS. 5, 6 and 9, may conveniently take the form of lugs 42 integral with the support surface 37 and the confronting lower surface of car bolster 39. A bearing pad 43, which may be of Teflon, or the like, is interposed between the upper surface of car bolster 39 and the overlying car sill structure 40 (FIGS. 6 and 9). This forms a sliding bearing surface, which operates to place a limit on flange forces which might otherwise become excessive in very sharp curves.

As will now be understood, the resilience of the elastomeric sphere-like members 38 provides the restraint identified as $k_e$ in the description with reference to FIGS. 1 and 2. As stated, its value is determined in accordance with the proportionality $k_a/k_e = s/2w$. In one embodiment of the invention, which yielded good results, sphere-like springs marketed by Lord Corporation, of Erie, Pa., and identified by part number J-13597-1, were found suitable for applicant's special purposes described above.

The truck shown in FIGS. 5–8 can be made to function as does the truck of FIGS. 1 and 2 by either omitting pads 30' at axle 11, or by making these pads substantially stiffer than pads 30 at axle 10. The benefit achieved by doing this is that the steering effect of a linkage L, such as shown in FIG. 4, is obtained merely by the proper distribution of the stiffness of pads at the axles.

A support, or cross-tie, 44 extends between the webs 35 of the side frames 29, in the central portion of the latter (FIGS. 5 and 6), and has its ends fastened to the side frame web as shown at 45 in FIG. 9. The cross-tie is a relatively thin plate with its height extending vertically, and its center portion has an aperture 46 through which passes the means 14 which couples the mid-portions of the two steering arms 12 and 13. The aperture 46 is of larger diameter than the coupling means 14, as shown in FIG. 9, and as also appears in FIG. 6. It is important for the purposes of the invention that there be freedom for limited tilting of one side frame with respect to the other, in the general plane containing the axles 10 and 11. (See also the flexible side frames T of the apparatus shown schematically in FIGS. 2 and 3.) In the present embodiment this freedom is ensured by limiting the thickness of the cross-tie 44 to a value such as to permit the required flexibility between side frames, and by the freedom for relative movement between means 14 and cross-tie 44, afforded by the clearance of the cross-tie in the aperture.

A pair of strut-like dampers 47,47 interconnect the side frames and the car bolster 39. While these dampers have been omitted from FIGS. 5 and 6, in the interest of clarity of illustration, they show to good advantage in FIG. 9. Their purpose is to damp vertical and horizontal excursion of the car body and, importantly, they are inclined inwardly and upwardly to minimize the effect of vertical tracks surface irregularities on lateral motion of the car body.

In certain embodiments of the present invention it has been found very advantageous to have a tow bar which interconnects one steering arm with the body of the car or other vehicle. The tow bar comprises the steering link L, in the diagrammatic representations of FIG. 4, and it appears at 48 in FIGS. 5, 6 and 9. Its disposition and point of securement to the car body are unique to this invention as has already been explained with reference to FIG. 4.

As best shown in FIGS. 5 and 9, the tow bar 48 has an arcuately formed portion 49 intermediate its ends and this portion 49 is journaled within and cooperates with spaced, confronting arcuate flanges 50,50, carried by the central part of the upper edges of the tie-bar 44. This cooperation provides for swinging movements of the tow bar about the center of its said arcuately formed portion 49 and permits the side frame assembly to serve as a point of reaction for torque forces imposed by the connection of the ends of the tow bar to one of the steering arms and to the car body. As illustrated in FIGS. 5 and 6, the left end of the tow bar overlies the steering arm 12, which should be understood as being associated with that axle 10 which is the more remote from the center of the car body. This end is connected to steering arm 12 by pivot mechanism represented by the pin 51. The opposite end of the tow bar extends in the direction of the center of the car body, and its pin 52 is rotatably carried by a tow bar trunnion 53 secured to a portion **41*a* (FIG. 6) of the car sill structure 40, at a point lying along the longitudinal center line of the car (FIG. 5**).

In accordance with this invention, and as described above with reference to FIG. 5, the point of securement of the tow bar 48 to the more remote steering arm 12 is at a point 51 whose location is a function of the truck assembly's wheelbase w, and the distance s between the two truck assemblies, under a car body. The minimum value of the distance x, from the truck center 49 to the point 51, should satisfy the expression $x_{min} = w^2/4\,(s + w)$. The primary function of the tow bar is to take care of longitudinal forces between the car body and the resiliently mounted wheelsets. Such forces arise, for example, from braking and coupling impacts. In conventional trucks, e. g. freight car trucks now in common use, where no tow bar is present, these forces associated with braking and coupling are passed through the bolster and side frames. In the apparatus of the present invention, these forces, particularly the forces caused by coupling impacts, would, if not properly dissipated, cause unacceptable deflections and wear in the elastomeric pads 30 which mount the steering arms to the side frames, and the side frames to the car body.

Reference is now had to a modified form of railway truck embodying the invention, and illustrated in FIGS. 13 through 15. In this somewhat simpler apparatus a cross bolster is embodied in the truck, and imposes the weight of the car upon the side frames. Additionally this truck bolster is flexibly associated with the two side frames and serves as the only interconnection between the two.

In terms of basic structure for supporting the axle-borne wheelsets, and for providing resilient damping at the axle end portions, and also between the truck and the car body, the apparatus is in many respects similar to the embodiments already described. Accordingly, like parts bear like designations, with the subscript b. Thus, axles **10*b* and 11*b* are, respectively, carried by generally C-shaped steering arms 12*b* and 13*b***, and each steering arm, as was the case in the preceding embodiment, has a portion extending from its associated axle, with respect to which it has a substantially fixed angularity, to a common region substantially midway between the two axles. Means 14*b* couples the steering arms with freedom for relative pivotal movement, and with predetermined substantial stiffness against lateral motion in the general direction of axle extension. In this embodiment, the coupling means 14*b* (see FIG. 15) comprises a pair of studs 55 and 56, each of which extends from an associated one of the steering arms toward the zone of coupling. The stud 55, carried by arm 12*b*, is recessed as shown at 57, while stud 56 has a reduced, hollow end portion 58 which extends within the recess. Elastomeric material 59, preferably rubber, is interposed between extension 58 and the interior wall defining the recess 57, and is bonded to the adjoining surfaces. A bolt 60 serves to retain the parts in assembly. Again, as was the case with the preceding embodiment, the coupling 14*b*, through which the steering moments are exchanged, has considerable lateral stiffness and an angular flexibility sufficient so that each axle is free to assume a position radial of a curved track and free to adjust to track surface irregularities.

As shown in the cross-sectional portions of FIG. 13, which is taken as indicated by the line 13—13 applied to FIG. 14, it will be seen that each steering arm has journal box structure 61, at each end thereof, and in this case flanging, shown at 62, projects from the journal box structure in the direction of the length of the truck. The journal box has an upper substantially flat surface 63 upon which is seated an elastomeric pad 64. These pads may be sandwiched in steel and, if desired, mounted upon the surface 63 in the manner already described with respect to FIGS. 5–8. The axles 10*b* and 11*b* are supported by structure which is of the character already described with respect to the earlier embodiment, and which fits within the downwardly facing pedestal opening provided by jaws 68. In practice, means (not shown) would be provided to retain the axle and the bearing adapter structure within the pedestal opening. Brakes have also not been illustrated, since in this embodiment, they would either be conventional or be of the kind already described with respect to FIGS. 5, 6 and 9.

In accordance with my invention, the truck side frames 65,65 are carried upon the bearing portions of the steering arms and, importantly, are supported upon the pads 64, as appears to good advantage in FIG. 14. Such pads have been shown at each end of each axle, although it will now be understood that they may be used at the ends of one axle only, or that pads providing different degrees of flexible restraint may be used with each axle. These pads, as will now be understood, restrain the steering motions of the axles with respect to each other and oppose departure of the subtrucks, which are comprised of the wheelsets and steering arms, from a position in which the wheelsets are parallel. Each side frame comprises a vertically extending web portion 66 having horizontal flanging 67 (FIG. 13) extending laterally from each side of the web. The flanging tapers from a substantial width in the central region, between the two steering arms, to a relatively narrow width where the arm overlies the pads 64. Each side frame has a pedestal opening between pedestal jaws 68 (FIG. 14) which straddles the journal box assembly and is restrained thereon by cooperation with the interior surfaces 69 of flanges 62, in the manner shown in FIG. 13. Each side frame 65 is provided with a generally rectangular aperture 70 (FIG. 14), the upper portion of which accommodates the end portions 72 of a truck bolster 71, and provides a seating surface for the springs 73 (in this case six are provided), which react between the side frame 65, at 74 as shown in FIG. 14, and the undersurface of the projecting end 72 of the truck bolster 71.

The bolster extends laterally of the width of the truck and provides articulated connection means between the two side frames. In this instance no tie-bar is used. The bolster ends, since they pass freely through upper portions of the side frame apertures 70, flexibly interconnect the side frames with the freedom for relative tilting movements which is characteristic of this invention. In a center part of the bolster, overlying the means 14*b* which couples the steering arms, and which does not contact the bolster 71 (see FIG. 14), there is a bowl-type receiver 75, for the car body center plate which, as will be understood by those skilled in this art, is fastened to the car's center sill, which is not illustrated. As is clear from the foregoing description, in the apparatus of this invention the coupler means (P in FIG. 1, 14 in FIGS. 5 to 9, 14*b* in FIGS. 13 to 15, and 14*c* in FIG. 16), is free for steering motions in a direction across or transversely of the truck. Thus, it is also true that lateral motion of truck parts, such as the truck bolster illustrated in FIG. 14, may occur independently of the motion of coupler means 14*b*.

To provide the resilient restraint identified as $k_e$, in the description with reference to FIGS. 1 and 2, that is the restraint between the truck and the car body, a pair of elastomeric pads 76,76 are carried, at spaced portions of the upper surface of truck bolster 71, being held there in any desired manner, and are cooperable with the car bolster (not shown) which forms part of the sill structure. The function of these pads will be understood without further description. It should also be understood that a less suitable, but in some cases adequate, yaw restraint of the truck bolster can be provided by a conventional center plate and side bearing arrangement.

Figure 16:
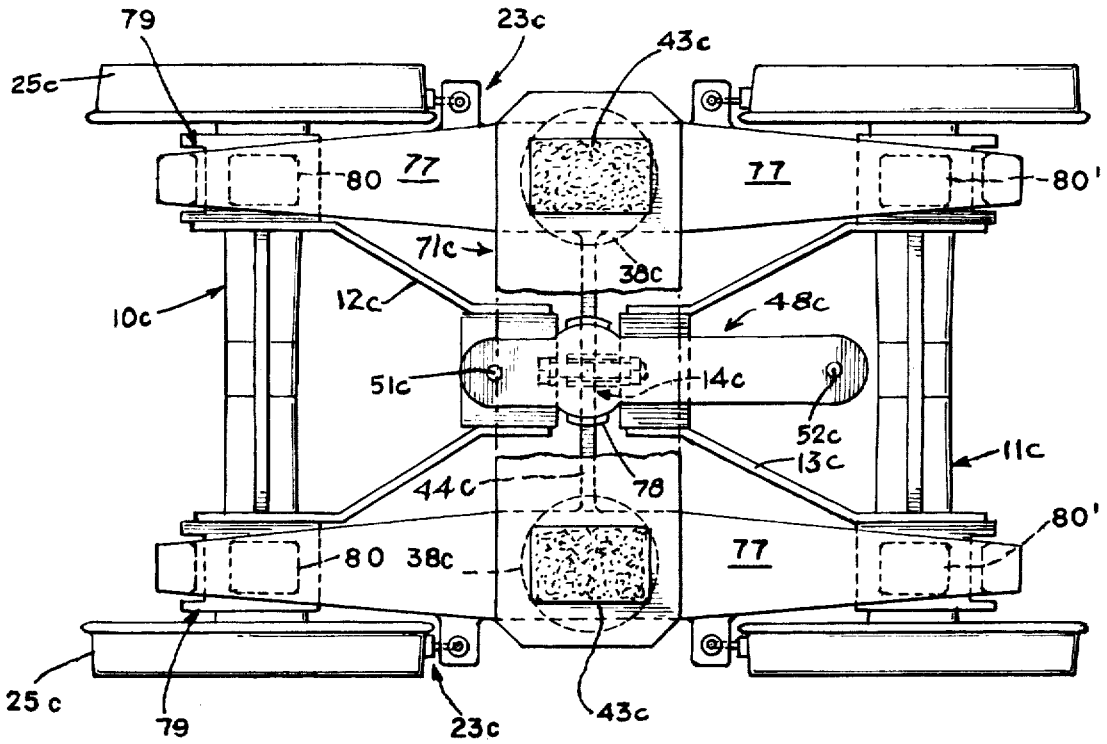
FIG. 16 is a plan view of another modified form of truck, similar to FIG. 5, but having inboard bearings.

In FIG. 16, there is illustrated another modified embodiment of the invention which, in this case, need be shown in plan view only. This embodiment adapts the principles of the invention to truck apparatus in which the side frames and bearings lie inboard of the wheels 25*c*, rather than outboard thereof. This apparatus has a number of advantages, i.e. the wheelsets are lighter, the axles are shorter, the bending moments in the axles are less and the steering arms and the associated mechanism may be of lighter construction, since they are smaller. The axles are shown at 10*c* and 11*c*, and the steering arms at 12*c* and 13*c*. Coupling means between the steering arms is shown at 14*c* and may, in this embodiment, take substantially the form shown and described in detail with reference to FIG. 15. A relatively flexible tie-bar 44*c* interconnects the two side frames 77,77. The construction and function of this tie-bar and of the central arcuate, seat structure 78 which it supports, is similar to the construction and operation of the corresponding parts already described with respect to the embodiment of FIGS. 5 and 6. Each steering arm has journal box structure 79, and each journal box structure supports an elastomeric pad 80 or 80'. These pads, which cooperate with the journal box and with end portions of the side frame structure 77 in the manner shown in FIGS. 13 and 14, serve the same purpose as is served by the pads 30 and 30' of the embodiment of FIGS. 5, 6 and 9, and by the pads 64 of the embodiment of FIGS. 13 and 14. This purpose is, of course, consistent with the principles shown schematically in FIGS. 1 and 2, and embodied in that structure by resilient restraint $k_a$. A truck bolster 71c is supported upon resilient members 38c, and the upper surface of the bolster carries a pair of spaced bearing pads 43c, 43c which are disposed for contact with the car body. These pads serve the purpose of pads 43, in FIG. 9.

In the embodiment of FIG. 16 a tow bar is also utilized. This bar (48c) is mounted for rotation about a region intermediate its ends, as described with reference to FIG. 5, and has pivot structure shown at 51c and 52c for cooperation, respectively, with the steering arm 12c and the car body, in the manner described with reference to FIGS. 4, 5 and 6. Brakes shown at 23c are carried by the side frames.

FIGS. 17 and 18 show alternative structure which is useful to provide some input to the steering action from lateral forces while limiting side-frame-to-steering-arm movement. This apparatus, which is shown as applied to journal box and side frame apparatus of the kind appearing in FIGS. 5 and 6, is particularly useful where there is no tow bar to provide coupling between the motion of the car body with respect to the truck and steering motion of the truck, as described with reference to FIGS. 5 and 6. In this embodiment, journal box structure 18d carries flanging between which is received an elastomeric pad 30d and a side frame apparatus 32d, all as shown and described with reference to FIGS. 5 and 6. Small stops 81 are each carried by one of the flanges and they are so positioned that the lateral forces between the side frame and the steering arm are transferred primarily through the stops rather than through the pads 30d. The eccentricity of these lateral stops (they are disposed eccentrically with respect to the center line of the axle, when viewed in plan) introduces a desirable steering action caused by lateral force. The direction of the steering action is chosen for stability to cause the wheelsets to turn in that direction which tends to keep them centered under the car body.

Finally, further reference should be made to the unique braking apparatus characteristic of the invention and to the advantages which are achieved thereby. In prior brake apparatus commonly used in the railroad art, the brake beam is supported by an extension member which rides in a slot in the truck frame. This system has several substantial drawbacks. The friction created at the slot interferes with precise control of the force between the wheel tread and the brake shoe, and the radial distance between the friction face of the shoe and its point of support in the slot, results in an overturning moment on the brake shoe which, in turn, causes large variations in the unit pressure between the shoe and the wheel tread, along the length of the shoe face. Another problem with conventional brake rigging is the large lateral clearance between the brake beams and the car truck side frames. With conventional trucks this clearance is required to prevent high lateral forces which would occur if the distortion of the truck framing in curves is limited by contact between the brake shoes and the wheel flanges. The above problems can combine to product stuck brakes, overheated wheels, wearing contact of the brake shoes with the wheel flanges, and even derailment due to wheel failure.

In the braking arrangement shown in FIGS. 7, 8 and 8a, these disadvantages are overcome, primarily because the association of the brake beams with the steering arms makes it possible virtually to eliminate uneven wear at the shoe and completely to prevent any contact between the shoes and the wheel flanges. Since the brake beams 24 are carried by hangers 27 which are supported in pad structures 28, formed integrally with the steering arms, and because of the fixed angular relationship between the wheelsets and the steering arms, the brake pads 26 always remain properly centered with respect to the wheel treads.

FIG. 8 shows how the proper choice of geometrical relationships can be used to provide two different values for the braking force B on the leading and trailing wheelsets. This compensates for the transfer of weight from the trailing to the leading wheelset during braking. Thus, providing this compensation reduces the risk of wheel sliding. The braking effect on the lead wheelset $B_L$ is made larger than the braking effect on the trailing wheelset, $B_T$, by choosing a center line for the hanger structure 27 which is inclined with respect to a line t, which is tangent to the wheel surface at the center of the brake shoe face. Referring to the two force polygons which comprise FIG. 8a, it can be seen that the effect of the mentioned angle is to create an angle between the vectors $R_L$ and $B_L$, and the vectors $R_T$ and $B_T$. The presence of these angles causes the normal force $N_L$, between the shoe and the lead wheel, to be larger than the force $N_T$ between the shoe and the trailing wheel. It is necessary to have the same ratio between the normal forces N and the braking forces B, for both wheelsets, and the ratio is established by the coefficient of friction chosen for the brake shoe material and the steel face of the wheel.

The total force applied to the brakes is shown in the drawings by arrows appearing on the brake beam linkage in FIGS. 7 and 8. As shown by the force polygon, the braking force applied to the beam linkage at the leading, or right hand, wheelset is $F_2$, while the force applied to the linkage at the trailing wheelset, is represented in the polygon as the equal and opposite $F_1$. Since two brake shoes are actuated by each beam assembly, the arrow showing brake actuator force for the leading wheelset is labeled $2F_2$, while the brake actuator force is labeled on the trailing wheelset as amounting to $2F_1$. As will be understood, this force can be supplied by any convenient conventional means (not shown), adapted to apply the force in the direction of the arrows shown on the center strut of the brake beam structure.

As indicated above, this apparatus substantially reduces brake shoe wear and results in much safer braking.

In summary, the apparatus shown in the several embodiments of the invention based, as it is, on recognition of the important part played by control of yaw and lateral stiffness, virtually eliminates flange contact in curves and greatly reduces flange forces when contact does occur. In addition, excellent high speed stability is achieved, with resultant minimization of wear and cost problems. As will now be understood, these advantages are achieved by providing restraining means between the side frames and the steering arms of a truck, to restrain yawing motion of the axles, by having the steering arms coupled through further restraining means, and by providing suitable restraining means between the side frames, or their associated bolster, and the body of the vehicle. Use of equal restraint between the side frames and the steering arms at each side, e.g. the four pads 30 in the embodiment of FIGS. 5 and 6, has the advantage of minimizing parts inventory and simplifying assembly and maintenance. Use of unequal restraint, which in some instances can be done by eliminating restraining pads at one axle, can further improve the radial steering action desired during curving.

Limiting the side frame car body forces, as for example by the use of the tow bar, is highly advantageous for reasons which will now be understood, while the use of eccentric lateral stops between the steering arms and the side frames can, in certain instances, provide a stabilizing benefit similar to that achieved by the tow bar steering linkage.

The invention has been analyzed mathematically, and illustrated schematically, as well as being shown and described with reference to several structural embodiments. While the emphasis herein has been on the use of elastomeric restraints, similar advantages can be achieved by the use of resilient steel springs. The use of elastomeric restraints, however, has the advantage of simultaneously providing side-frame-to-car-body elasticity, while also providing both vertical and lateral flexibility in the suspension.

In general, however, it will be understood that the use of steel restraints, or of such other structural modifications as properly come within the terms of the appended claims, are within the scope of this invention.

I claim:

1. A vehicle running-gear comprising:

at least two load-carrying axles, movable to different relative angularities in a horizontal plane, each of said axles having a pair of spaced-apart wheels mounted thereon and adapted to transmit weight from the axle to the running surface on which the wheels roll; a pair of frame structures, one for each of said two axles, each frame structure having means for mounting its associated axle, and having in relation to its associated axle a substantially fixed angularity in a horizontal plane, and each frame structure extending from its associated axle to a common region substantially midway between said two axles; means in said region pivotally connecting one frame structure directly to the other thereof for transmitting steering forces between the axles, said means having predetermined stiffness against lateral motion in the direction of axle extension; framing including a pair of truck side frames each spanning a pair of adjacent axle ends and providing support thereof, said framing transmitting vehicle weight to the frame structures and thence to the axles independently of said means for pivotally connecting said frame structures; elastic means disposed to react between the ends of at least one axle and said side frames to provide restraint of the steering motions of the axles with respect to each other; and other elastic means for restraining motions of the axles with respect to the vehicle.

2. In a vehicle having at least one pair of axle-born wheelsets the axles of which are longitudinally spaced from the center of the vehicle in generally parallel adjacency and lie in a plane within which said axles may yaw, apparatus for mounting said wheelsets upon said vehicle including mechanism for transmitting load from the vehicle to the wheelsets and providing for relative pivotal, yawing, movements of the axles in said plane, as the wheels roll on a running surface, said apparatus comprising: a pair of frame structures, each coupled to an associated one of said axles in such manner that each axle has a substantially fixed angularity with respect to its frame structure in said plane, each frame structure having a portion extending from its associated axle to a common region substantially midway between said two axles; means coupling said frame structures directly to one another in said region, and independently of said load transmitting mechanism, for relative yawing movement, and with predetermined stiffness against motions in the general direction of axle extension; a pair of side frame members each extending to and spanning a pair of adjacent end portions of the two axles, said frame members being free for relative tilting movements in said plane; means forming connections coupling each end portion of each axle, and its frame structure, to the adjacent side frame member, the connections coupling the ends of that axle which is more remote from the center of said vehicle, with the adjacent side frame members, including means providing elastic restraint of predetermined stiffness against yawing movements of the latter axle; and means coupling each side frame member to said vehicle and including other elastic restraint means providing predetermined yaw stiffness between said frame members and the vehicle.

3. In a vehicle having at least one pair of axle-born wheelsets the axles of which are longitudinally spaced from the center of the vehicle in generally parallel adjacency and lie generally in a plane within which the axles may be pivoted, apparatus for mounting said wheelsets upon said vehicle including mechanism for transmitting load from the vehicle to the wheelsets and providing for relative pivotal yawing movements of the axles in said plane, as the wheels roll on a running surface, said apparatus comprising: a pair of frame structures, each coupled to an associated one of said axles in such manner that each axle has a substantially fixed angularity with respect to its frame structure in said plane, each frame structure having a portion extending from its associated axle to a common region substantially midway between said two axles; means coupling said frame structures directly to one another in said region, for relative pivotal movement, the coupling being independent of the load transmitting mechanism, said last recited means including restraint means affording predetermined stiffness against motions in the general direction of axle extension; a pair of spaced side frame members each spanning the two axles in outboard regions of the latter, said frame members being free for relative movements with respect to said vehicle and to each other in said plane; bolster means spanning said side frame members and imposing the vehicle load upon said frame members; means forming connections coupling said outboard regions of each axle, and its frame structure, to the adjacent side frame member, said connections at least at one axle including means providing elastic restraint against yawing movements of the axle; and other restraint means cooperating with said bolster means to couple each side frame member to said vehicle, and providing restraint of the motion between said frame members and the vehicle.

4. In combination with a vehicle, a truck comprising; at least two load-carrying axles, movable to different relative angularities in a horizontal plane, each of said axles having a pair of spaced-apart flanged wheels mounted thereon and adapted to transmit weight from the axle to the running surface on which the wheels roll; a pair of steering arms, one for each of said two axles, each steering arm having means for mounting its associated axle, and having in relation to its associated axle a substantially fixed angularity in a horizontal plane, and each steering arm extending from its associated axle to a common region substantially midway between said two axles; means in said region pivotally connecting one steering arm directly to the other thereof for transmitting steering forces between the axles; framing spanning the two axles in regions offset from the centers of the two axles; means associated with said framing for transmitting vehicle weight to the steering arms and thence to the axles independently of said means for connecting the steering arms; and elastic means disposed to react between the steering arm and the framing, in said offset regions of at least one axle, said elastic means being of stiffness sufficient to provide restraint of the steering motions of the axles with respect to each other.

5. Apparatus in accordance with claim 4, and in which said elastic means comprises pads of elastomeric material interposed between the steering arm and the framing.

6. Apparatus in accordance with claim 4, and in which said elastic means comprises pads of elastomeric material interposed between the steering arm and the framing in the region of only that axle which is more remote from the center of the vehicle.

7. Apparatus in accordance with claim 4, and further including bolster means spanning the truck, in the direction of axle extension, and elastic means cooperable with said bolster means to restrain motions of the axles with respect to the vehicle.

8. A railway vehicle truck assembly comprising at least two rotatable load-carrying axles, movable to different relative angularities in a horizontal plane, each of said two axles having a pair of spaced-apart flanged wheels mounted normally fixedly thereon to rotate therewith and adapted to transmit weight from the axle to a pair of rails, main truck framing having pivot means for articulation with the vehicle body, a pair of sub-frame structures, one for each of said two axles, each sub-frame structure being coupled to the main truck framing and having means for rotatively mounting its associated axle, and having, in relation to its associated axle, a substantially fixed angularity in a horizontal plane, and each sub-frame structure extending from its associated axle to a common region substantially midway between said two axles and substantially equispaced from the two wheels of the associated axle, pivotal connection means joining said sub-frame structures in said region, independently of lateral force transmitting connection with said main truck framing and its said pivot means, and displaceable to accommodate conjoint swinging of said sub-frame structures and consequent positioning of their axles substantially radially of a curved track, and resilient means opposing departure of said frame structures from a position in which the axles are parallel.

9. In combination with a railway vehicle body, a pair of truck assemblies each comprising at least two rotatable load-carrying axles one of which is more remote from the center of the vehicle than the other, the axles being movable to different relative angularities therebetween in a horizontal plane, each of said two axles having a pair of spacedapart flanged wheels fixedly mounted thereon to rotate therewith and adapted to transmit weight from the axle to a pair of rails, main truck framing, a pair of sub-frame strucutres, one for each of said two axles, each sub-frame structure being coupled to the main truck framing and having means for rotatively mounting its associated axle, and having a substantially fixed angularity in a horizontal plane with relation to its associated axle, and each sub-frame structure extending from its associated axle to a common region substantially midway between said two axles and substantially equispaced from the two wheels of the associated axle, pivotal connection means joining said sub-frame structures in said region independently of the coupling thereof to the truck framing, the pivotal connection means being bodily displaceable to accommodate conjoint swinging of said frame structures and consequent positioning of their axles substantially radially of a curved track, resilient means resistively opposing swinging movements of said frame structures with respect to each other, and means in each truck assembly pivotally connecting the sub-frame structure for the axle which is more remote from the center of the railway vehicle to the railway vehicle at a predetermined point which lies generally on the longitudinal center line of the vehicle and is closer to the vehicle center than the coupling of said sub-frame structure to said truck framing.

10. Apparatus in accordance with claim 9, in which said last means comprises a tow bar extending generally along the longitudinal center line of the vehicle and having an intermediate portion pivotally coupled to said main truck framing with freedom for swinging movements of said tow bar about said intermediate portion, that end portion of said tow bar which is closer to the center of the vehicle being pivotally mounted to said vehicle, and the other end portion being pivotally mounted to that subframe structure which is more remote from the center of the vehicle.

11. In combination with a railway vehicle, a truck assembly comprising: main truck framing; first means movably associating said framing in load bearing relation with the railway vehicle; a pair of sub-trucks each movably coupled to said main truck framing and each carrying an axle-borne wheelset, each said sub-truck having a portion extending from its associated wheelset to a common region substantially midway between the two axles; means in said region coupling said sub-trucks to one another independently of yaw-inducing connection with said framing, for conjoint steering motions and consequent positioning of their axles radially of a curved track; and resilient means interposed between spaced portions of at least one sub-truck and said main truck framing; said resilient means being of stiffness sufficient to oppose departure of said sub-trucks from a position in which the wheelsets are parallel.

12. Apparatus in accordance with claim 11, and in which each sub-truck has a pair of spaced portions each of which carries journal box means, each such journal box means rotatively supports a portion of the associated axle, and said resilient means is disposed to react between at least certain of said journal box means and said main truck framing.

13. Apparatus in accordance with claim 11, and in which each sub-truck has a pair of spaced portions each of which carries journal box means, each such journal box means rotatively supports a portion of the associated axle, and said resilient means comprises pads of elastomeric material, each pad sandwiched between relatively thin metal sheets, with one metal sheet disposed to be supported by a surface of said journal box means, and the other metal sheet disposed in load-bearing relation with respect to said main truck framing.

14. In a vehicle truck assembly, main truck framing comprising: a pair of spaced, generally parallel, framing elements interconnected by a flexible cross-tie; a pair of steering arms each having spaced portions journalling an axle-borne wheelset, each steering arm having a portion extending from its associated wheelset to a common region substantially midway between the two axles; means in said regions pivotally intercoupling said steering arms independently of connection with said framing, for yawing movements and consequent positioning of their axles radially of a curved path; resilient means of predetermined stiffness arranged to react between said framing elements and at least one of said steering arms to oppose departure of said steering arms from a position in which said wheelsets are parallel; and tow bar means extending generally along the horizontal center line of said truck in the direction of intended motion thereof, said tow bar means having an intermediate portion resiliently and pivotally coupled to said cross-tie, in the mid-region of the length thereof, with freedom for swinging movements of said tow bar means about said intermediate portion, one end portion of said tow bar means having provision for pivotal mounting of a vehicle with which the truck is to be associated, and the other end portion being pivotally mounted to one of said steering arms.

15. In a railway vehicle truck assembly: main truck framing having for pivotal association with a railway vehicle; a pair of sub-trucks each movably coupled to said main truck framing and each carrying an axle-borne wheelset, each said sub-truck having a portion extending from its associated wheelset to a common region substantially midway between the two axles; means in said region independent of such pivotal association means coupling said sub-trucks, independently of said main truck framing, with freedom for conjoint yawing motions, and consequent positioning of their axles radially of a curved track, and for differential displacement of said sub-trucks in the yaw direction; resilient means of predetermined stiffness constructed and arranged to oppose departure of said sub-trucks from a position in which the wheelsets are parallel; and further resilient means constructed and arranged to oppose such differential displacement.

16. In combination with a railway vehicle, truck apparatus comprising: main truck framing including a pair of spaced, generally parallel, framing elements flexibly interconnected by a weight-carrying truck bolster member which extends between said elements and has end portions each of which is moveably linked to a mid-portion of a corresponding one of said framing elements; a pair of sub-trucks each having spaced regions disposed in load-bearing relation to end portions of said framing elements and journalling an axle-borne wheelset, each said sub-truck having a portion extending from its associated wheelset to a common zone substantially midway between the two axles, means in said zone coupling one sub-truck directly to the other thereof independently of weight-carrying association with said bolster member, for swinging movements and positioning of their axles radially of a curved track; first resilient means disposed to react between said framing elements and at least one sub-truck, in such spaced regions of the latter; and at least a pair of elastomers pads disposed to react between said vehicle and spaced areas of said truck bolster member.

17. In a railway vehicle truck, having main framing and a pair of axle-borne wheelsets each carried by a steering arm which has spaced portions journalling its associated wheelset, and which steering arms have means pivotally connecting them directly to one another, in a region substantially midway between said two axles, and accommodating positioning of the axles radially of a curved track, to insure that steering moments are freely exchanged between said wheelsets, means for minimizing wheel-flange-to-rail contact, and for maximizing high speed stability, said means comprising: first elastomeric means proportioned and disposed to provide each wheelset with a predetermined value of yaw stiffness with respect to the main framing; second elastomeric means proportioned and disposed to provide a predetermined value of yaw stiffness between the main framing and the vehicle body; and third elastomeric means proportioned and disposed to resist differential displacement of said steering arms while permitting exchange of such steering moments between the wheelsets and thereby permit each axle to assume a position radial of a curved track.

18. In combination with a railway vehicle, a truck comprising: at least two load-carrying axles, movable to different relative angularities therebetween in a horizontal plane, each of said axles having a pair of spaced-apart flanged wheels mounted thereon and adapted to transmit weight from the axle to the track on which the wheels roll; a pair of steering arms, one for each of said two axles, each steering arm having means for mounting its associated axle, and having in relation to its associated axle a substantially fixed angularity in a horizontal plane, and each steering arm extending from its associated axle to a common region substantially midway between said two axles; means in said region providing pivotal connection between the steering arms for transmitting forces between the axles; framing spanning the two axles in outboard regions of the latter and transmitting vehicle weight to the steering arms and thence to the axles; elastic means of predetermined stiffness disposed to react between the steering arm and the framing, in the region of each end of at least one axle, to provide restraint of the steering motions of the axles with respect to each other, a brake disposed for cooperation with the tread of each wheel of each axle; brake beam means for each axle, coupled to the brakes for the wheels of that axle; means for applying force to each brake beam means, to apply the shoe of each brake to the tread of its associated wheel; and means preventing movement of the brakes in the direction of axle extension, whereby to prevent contact between the brakes and the wheel flanges, said means preventing movement of the brake comprising structure so coupling each brake beam means, and the steering arm which supports the corresponding axle, as to prevent displacement of the brake beam means in the direction of axle extension.

19. Apparatus in accordance with claim 18, and in which there is included means so supporting the brakes with respect to the wheels, as to insure that the normal force between a leading wheel and the shoe of its brake is greater than the normal force between a trailing wheel and the shoe of its brake.

20. In a railway truck assembly; main truck framing for pivotal association with a railway vehicle; a pair of axle-carrying sub-trucks each of which has a pair of spaced portions carrying a journal box having a generally plane, upwardly facing surface and an open, downwardly facing recess within which is journalled a portion of the associated wheel-carrying axle; means, disposed in a region generally midway between the two axles, coupling said sub-trucks for pivotal yawing movements, said main truck framing having load carrying portions extending into overlying load-imposing relation with respect to said surface of each of said journal boxes; elastomeric means disposed to react between said framing portions and at least certain of said surfaces to introduce elastic restraint therebetween; and means disposed eccentrically with respect to the center line of the axle when viewed in plan, and cooperative with such boxes, and with the overlying framing portions, to transmit lateral forces between the journal boxes and said framing portion.

21. Apparatus in accordance with claim 20, and in which said journal boxes are provided with spaced flanges between which said framing portions are received, and said last means comprises stops carried by said flanges.

22. In combination with a vehicle, a truck comprising: at least two load-carrying axles, movable to different relative angularities in a horizontal plane, each of said axles having a pair of spaced-apart flanged wheels mounted thereon and adapted to transmit weight from the axle to the running surface on which the wheels roll; a pair of steering arms, one for each of said two axles, each steering arm having means for mounting its associated axle, and having in relation to its associated axle a substantially fixed angularity in a horizontal plane, and each steering arm extending from its associated axle to a common region substantially midway between said two axles; means in said region pivotally connecting one steering arm directly to the other thereof for transmitting steering forces between the axles; framing spanning the two axles in regions offset from the centers of the two axles; means associated with said framing for transmitting vehicle weight to the steering arms and thence to the axles independently of said means for connecting the steering arms; elastic means disposed to react between the steering arm and the framing, in said offset regions of at least one axle, said elastic means being of stiffness sufficient to provide restraint of the steering motions of the axles with respect to each other; and means for limiting the maximum value of wheel flange forces in sharp curves, said limiting means comprising a relatively low friction pad disposed to bear vehicle weight and slidable in response to substantial flange forces, to thereby limit the same.

* * * * *